US005152849A

United States Patent [19]

Bittner et al.

[11] Patent Number: 5,152,849

[45] Date of Patent: Oct. 6, 1992

[54] PHOSPHATING PROCESS

[75] Inventors: Klaus Bittner, Frankfurt; Gerhard Müller, Hanau am Main; Werner Rausch, Oberursel; Klaus Wittel, Frankfurt, all of Fed. Rep. of Germany

[73] Assignee: Metallgesellschaft Aktiengesellschaft, Frankfurt am Main, Fed. Rep. of Germany

[21] Appl. No.: 683,106

[22] Filed: Apr. 10, 1991

Related U.S. Application Data

[63] Continuation of Ser. No. 395,478, Aug. 18, 1989, abandoned.

[30] Foreign Application Priority Data

Aug. 24, 1988 [DE] Fed. Rep. of Germany ..... 3828676

[51] Int. Cl.[5] ..... C23C 22/12

[52] U.S. Cl. ..... 148/262

[58] Field of Search ..... 148/262

[56] References Cited

U.S. PATENT DOCUMENTS 4,824,490 4/1989 Oei ..... 148/260

*Primary Examiner*—Sam Silverberg

*Attorney, Agent, or Firm*—Felfe & Lynch

[57] ABSTRACT

Disclosed is a process for phosphating a galvanized surface, particularly of galvanized steel wherein the surface is contacted for up to 10 seconds with a phosphating solution which contains accelerator, particularly nitrate, 0.5 to 5.0 g/l zinc, 3 to 20 g/l phosphate (calculated as $P_2O_5$), 0.3 to 3 g/l magnesium at a weight ratio of magnesium: zinc=(0.5 to 10):1 and has an S value in the range from 0.2 to 0.4 preferably in the range from 0.2 to 0.3, and is replenished with a concentrate in which the weight ratio of zinc to phosphate (calculated as $P_2O_5$) is in the range from (0 to 1):8.

It is particularly desirable to use a phosphating solution which contains up to 1.5 g/l zinc, preferably 0.5 to 1 g/l zinc, at a weight ratio of magnesium: zinc of (0.5 to 3:1, nickel ions in an amount of up to 1.5 g/l, preferably in an amount of up to 0.5 g/l and simple or complex fluoride in an amount of up to 3 g/l, preferable 0.1 to 1.5 g/l (calculated as F in each case).

A special advantage is afforded by the use of the process to treat galvanized steel strip which is subsequently painted or coated with a preformed organic film.

28 Claims, No Drawings

PHOSPHATING PROCESS

This application is a continuation of application Ser. No. 07/395,478, filed Aug. 18, 1989, now pending.

BACKGROUND OF THE INVENTION

The present invention is in a process of phosphating galvanized surfaces, particularly of galvanized steel, by a treatment with aqueous phosphating solutions which contain zinc ions, phosphate ions, additional layer-forming cations and accelerator, and to the use of that process for the treatment of galvanized steel strip, which treatment is optionally followed by the application of paint or a preformed organic film.

From Published German Application 21 00 021 it is known to treat metal surfaces with phosphating solutions which contain nickel as an essential cation. In that case, phosphate layers which in addition to zinc contain substantial amounts of nickel as a cation are formed on zinc surfaces. Such layers have a very high resistance to corrosion, particularly when they have been afterrinsed with the usual afterrinsing liquors, which contain Cr(VI)-Cr(III). The layers also constitute an excellent primer for paint to be applied to the strip. But that process has the disadvantage that the conversion layer which has been formed has a relatively dark, almost black, color, which is not attractive and gives rise to color problems in case of an application of bright and white paints.

Published German Application 32 45 411 describes a process of forming zinc phosphate layers on electrolytically galvanized steel. An advantage of that process resides in that a mass of less than 2 g/m$^2$ hopeite is obtained within a short time so that the resulting galvanized and phosphated strip can subsequently be welded. A disadvantage resides in the restriction to electrolytically galvanized surfaces. Since strip which has been hot dip galvanized has a low reactivity to the phosphating solution, it is not possible, in most cases, to form the desired layer in a desirable short treating time.

It is also known that phosphate layers which mainly consist of hopeite ($Zn_3(PO_4)_2.4H_2O$) are inferior in its properties in comparison to phosphate layers which mainly consist of phosphophyllite ($Zn_2Fe(PO_4)_2.4H_2O$) (K. Wittel: "Moderne Zinkphosphatier-Verfahren-Niedrig-Zink-Technik", IndustrieLackierbetrieb, 5/83, page 169, and 6/83, page 210). However, commercially feasible processes for forming phosphophyllite layers on zinc surfaces are not yet known.

It is an object of the invention to provide for the phosphating of galvanized surfaces a process which can be used with equally good results with zinc coatings which have been applied electrolytically or by a hot dip process and which will result in a formation of bright, almost white coatings. It is also an object of the present invention to provide a process which results in the formation of phosphate layers of less than 2 g/m$^2$ and which will provide a good bare corrosion protection, i.e., a corrosion protection solely effected by the phosphate layer and can be used as a primer for paint and preformed organic films. It is a further object of the present invention to provide a process which will result in the formation of coherent coatings within a short time.

THE INVENTION

To accomplish the above objectives and others, the process of the invention is carried out in such a manner that the surfaces are contacted for a period "t" up to 10 seconds ($0<t\leqq 10$) with a phosphating solution which contains 0.5 to 5.0 g/l zinc.

3 to 20 g/l phosphate (calculated as $P_2O_5$), 0.3 to 3 g/l magnesium at a weight ratio of magnesium:zinc=(0.5 to 10):1 and has an S value in the range from 0.1 to 0.4 and is replenished with a concentrate in which the weight ratio of zinc to phosphate (calculated as $P_2O_5$) is in the range from (0 to 1):8.

The term zinc coatings describes such coatings which consist of pure zinc or of zinc alloys which contain zinc as a main constituent. These include, e.g., Galfan (about 5% Al, less than 1% misch metal, balance zinc), zinc-nickel alloys (about 10% Ni, balance Zn), zinc-iron alloys and zinc-cobalt alloys.

Generally, usual accelerators in the usual amounts are used in the above-mentioned phosphating solution and may consist, e.g., of nitrite, chlorate, peroxide, organic nitro or peroxide compounds, and particularly nitrate.

The phosphating solution employed in the process in accordance with the invention has a relatively high S value and is thus highly aggressive to the zinc surface. For this reason the phosphating solution is replenished in accordance with the invention with a concentrate which when compared with conventional concentrates contains little or no zinc. An S value in the range of from 0.2 to 0.3 is particularly desirable. The S value is the ratio of "free acid"—calculated as $P_2O_5$—and the so-called "Fischer total acid", i.e., the total amount of $P_2O_5$, expressed as the consumption of 0.1N NaOH in the titration of a bath sample of 10 ml (see W. Rausch: "Die Phosphatierung von Metallen", Eugen G. Leuze Verlag, Saulgau 1974, pages 274 to 277).

Phosphate layers having particularly desirable properties will be obtained if, in accordance with a more preferred embodiment of the invention, the surfaces are contacted with a phosphating solution which contains up to 1.5 g/l zinc ($0<Zn\leqq 1.5$ g/l), and especially preferably 0.5 to 1 g/l zinc, at a weight ratio of magnesium: zinc of (0.5 to 3):1.

In accordance with a further desirable embodiment of the invention the surfaces are contacted with a phosphating solution which additionally contains nickel ions in an amount of up to 1.5 g/l ($0<Ni\leqq 1.5$ g/l), preferably in an amount of up to 0.5 g/l. The resulting partial incorporation of nickel in the phosphate layer will further improve the quality of that layer. If the concentration of nickel is higher, the nickel content may be excessive so that the magnesium content may be insufficient.

If particularly short treating times are desired or aged galvanized surfaces or hot dip-galvanized surfaces are to be treated, the process may be carried out in accordance with a further desirable feature of the invention in that the surfaces are contacted with a phosphating solution which additionally contains simple or complex fluoride in an amount of up to 3 g/l ($0<F\leqq 3$ g/l), preferably 0.1 to 1.5 g/l (calculated as F in each case). For that purpose, e.g., hydrofluoric acid, alkali fluoride, ammonium fluoride or zinc fluoride or the corresponding bifluorides may be used or complex fluorides compounds consisting of the acids or of the salts with alkali, ammonium or zinc ions. Examples of complex fluoride compounds are $BF_4^-$, $SiF_6^{--}$, $PF_6^-$, $ZrF_6^{--}$ or $TiF_6^{--}$.

During the treatment of the surfaces, the chemicals of the treating solution are consumed. The phosphating solution is thus replenished with a concentrate. Because the phosphating solution is highly aggressive, the zinc ions required for the formation of the layer mainly come from the surface being treated resulting in a layer of desirable properties. The phosphating solution is preferably replenished with a zinc-free concentrate.

If nitrate is used as an accelerator, the concentrate used to replenish should suitably have a weight ratio of $NO_3$:$P_2O_5$ in the range from (0.15 to 0.7):1, preferably in the range from (0.3 to 0.5):1.

The surface to be phosphated must be free from organic and inorganic impurities. This will be ensured if the process in accordance with the invention is carried out in an electrolytic zinc galvanizing line. In other cases it is usual to clean with cleaning solutions, mostly in an alkaline but also in an acid medium, followed by a rinsing with water in one or more stages.

To form a firmly adhering, finely crystalline phosphate layer, the surface to be treated is suitably contacted with a so-called activating agent, which contains finely ground zinc phosphate or specially produced compounds of titanium and phosphate ions. The activating agent is applied by dipping or flooding, preferably by spraying. That treatment will be performed for 0.5 to 3 seconds if the process in accordance with the invention is used to treat strip material.

The activation is succeeded by the phosphating in accordance with the invention. That phosphating is effected by dipping or flooding, preferably by spraying. The spraying pressure is suitably 0.5 to 2 bars and preferably 0.5 to 0.8 bar. The temperature of the treating solution is mostly in the range from 40° to 65° C. A light gray layer of phosphate of zinc and magnesium is formed during that treatment. The mass of the layer is less than 2 g/m$^2$ and, in most cases, less than 1.5 g/m$^2$.

The phosphating treatment is followed by a rinsing with water for removing unreacted treating solution from the surface of the treated workpiece. That rinsing may be omitted if specially adjusted treating solutions are employed.

The resulting phosphate layers may finally be afterrinsed with afterrinsing liquors before they are dried. Weak acid solutions, which contain chromium(VI) and/or chromium(III) ions, are used in most cases for that purpose.

In principle, the process of the invention can be carried out on all galvanized surfaces within the above-mentioned definition of "galvanized". A particularly desirable use is the treatment of steel strip which has been galvanized, preferably electrolytically galvanized. Electrolytically galvanized steel strip can be phosphated immediately after the galvanizing in the galvanizing line.

If the phosphating, optionally with an afterrinsing, is the final treatment, it is used to provide protection in storage against the formation of white rust (white storage stain) and to improve the properties of the galvanized strip during deformation, particularly to reduce the abrasion of zinc during pressing and deepdrawing and to reduce tool wear.

The process in accordance with the invention may also be used to pretreat steel strip which has been galvanized electrolytically or by a hot dip process and which is to be coated with paint or with preformed films of organic polymers. In that case the phosphating in accordance with the invention is performed to improve the adhesion and the corrosion resistance of the organic coatings which are subsequently applied. That process is known in the art as "coil coating". The paints employed are highly flexible and include, e.g., alkyl, acrylate, epoxide, polyester, silicone-modified acrylate and polyester paints as well as polyvinyl chloride organosols and plastisols and polyvinyl fluoride and polyvinylidene fluoride systems. The suitable preformed films particularly include films of polyvinyl chloride, polyvinyl fluoride or thermoplastic acrylates.

The invention will be explained by way of example and more in detail in the following examples.

EXAMPLES

Control Example a

Examples 1 and 2 in accordance with the invention Steel sheets of grade RSt 1405 which were just electrolytically galvanized were activated by being sprayed for 3 seconds at 1.0 bar and 35° C. with a commercially available activating agent which contains 1 g/l titanium phosphate (5% by weight Ti-$PO_4$, 90% by weight $Na_2HPO_4$, 5% by weight $Na_3PO_4$) in deionized water. The sheets were then subjected to a phosphating treatment with solutions having the concentrations stated in the Table in deionized water by spraying for 5 seconds at 0.8 bar and 55° C. The phosphating solutions were replenished with a zinc-free concentrate having an $NO_3$:$P_2O_5$ ratio of 0.4:1 to maintain the total acid content constant. $NO_2$ and any Ni, Mg, and F which were employed were replenished to maintain the concentration constant. The treated sheets were then rinsed with tap water, which was sprayed for 2 seconds at 1.5 bars and 25° C., and afterrinsed by spraying for 2 seconds at 0.8 bar and 55° C. with a commercially available passivating agent which contains Cr(VI)/Cr(III) (0.2 g/l $CrO_3$, 0.037 g/l CrIII, pH 3.5–4) in deionized water. The sheets were then dried in an air-recirculating oven for 20 seconds at 120° C.

The color was then evaluated by comparison and the mass per unit of area was determined by peeling in accordance with DIN 50 942. The bare corrosion resistance was determined by a condensate-humidity alternating conditions test in accordance with DIN 50 017. 6 cycles which did not result in visible corrosion were selected as a criterion for an adequate behavior.

A coherent layer was formed in all Examples.

It is apparent from the Table that the processes in accordance with the invention afford advantages as regards the mass per unit of area and the appearance of the layer.

Control Example b

Examples 3 and 4 in accordance with the invention

Galvanized steel sheets were cleaned by spraying for 10 seconds at 1.2 bars with 10 g/l of a commercially available, strongly alkaline cleaner (50% by weight NaOH, 20% by weight $Na_2CO_3$, 26% by weight $Na_2SiO_3$, 4% by weight surfactant) in tap water and then rinsed with tap water by spraying for 3 seconds at 1.5 bars and 25° C. The rinsed sheets were activated by spraying for 3 seconds at 1.0 bar and 35° C. with 1.3 g/l of the above-mentioned commercially available activating agent in deionized water. Phosphating solutions having the concentrations stated in the Table in deionized water were sprayed for 8 seconds at 1.2 bars and 55° C. on the sheets. The phosphating solutions were replenished with a zinc-free concentrate having an $NO_3$:$P_2O_5$ ratio of 0.4:1 to maintain the total acid content constant. $NO_2$ and any Ni, Mg, and F which were employed were replenished to maintain the concentration constant. The phosphated sheets were rinsed with tap water, which was sprayed for 2 seconds at 1.5 bars and 25° C. and then afterrinsed with the above-mentioned commercially available passivating agent in deionized water by spraying for 2 seconds at 0.8 bar and 55° C. Then the sheets were dried in an air-recirculating oven for 20 seconds at 120° C.

The color and the mass per unit of area were determined (Table). Part of the sheets were painted with a commercially available coil-coating system consisting of an epoxide primer and an acrylate top coat. Two sheets of each Example were coated and subsequently tested in the salt spray test. Two sheets of each Example were tested for adhesion in the T bend test. The Table indicates the improved adhesion which is due to the process in accordance with the invention and the advantage afforded by the distinctly brighter color so that even bright monolayer paints can be used, e.g., in the domestic appliances industry.

TABLE

| | Example | | | | | |
|---|---|---|---|---|---|---|
| | a | 1 | 2 | b | 3 | 4 |
| Material[a)] | E-Zn | E-Zn | E-Zn | H-Zn | H-Zn | E-Zn |
| S value | 0.20 | 0.20 | 0.25 | 0.13 | 0.20 | 0.24 |
| $P_2O_5$ (g/l) | 5.5 | 4.0 | 8.0 | 6.0 | 6.0 | 5.5 |
| Zn (g/l) | 2.0 | 1.0 | 0.8 | 3.0 | 1.0 | 0.9 |
| Ni (g/l) | 0.08 | 0.05 | — | 0.8 | 0.02 | — |
| Mg (g/l) | — | 1.0 | 2.0 | — | 1.0 | 1.5 |
| $NO_3$ (g/l) | 2.5 | 2.5 | 4.0 | 6.0 | 3.0 | 2.9 |
| $NO_2^-$(mg/l) | 50 | 50 | 50 | 80 | 80 | 60 |
| $F^-$ (g/l) | — | — | 0.01 | 0.08 | 0.08 | — |
| Color | dark gray | light gray | light gray | dark gray | light gray | |
| Mass (g/m$^2$)[b)] | 1.8 | 1.4 | 1.5 | 3.1 | 1.3 | 1.2 |
| Corrosion resistance [c)] | OK | OK | OK | OK | OK | OK |
| Adhesion[d)] | — | — | — | not OK | OK | OK |

[a)]E-Zn: Electrolytically galvanized steel H-Zn: Hot dip-galvanized steel
[b)]Mass per unit of area, see DIN 50 941
[c)]For Examples a, 1 and 2: 6 cycles in the condensate-humidity alternating conditions test in accordance with DIN 50 017: OK = no corrosion for Examples b. 3 and 4: 480 hours salt spray in accordance with DIN 50 021 with scoring: OK = rate of creep back less than 3 mm
[d)]For Examples b, 3 and 4: T bend test in accordance with ECCA-T 7 (1985) OK: No flaking in T 2 test; not OK: Flaking in T 2 test It will be understood that the specification and examples are illustrative but not limitative of the present invention and that other embodiments within the spirit and scope of the invention will suggest themselves to those skilled in the art.

We claim:

1. A process for phosphating a galvanized surface, particularly a surface of galvanized steel comprising: contacting the galvanized surface for a period up to 10 seconds with an aqueous solution comprising:

0.5 to 5.0 g/l zinc, greater than 0 and up to 1.5 g/l nickel, 3 to 20 g/l phosphate calculated as $P_2O_5$, 0.3 to 3 g/l magnesium, and an accelerator, the solution having a weight ratio of magnesium: zinc=(0.5 to 10): 1 and an S value in the range from 0.1 to 0.4; and replenishing the solution with a concentrate in which the weight ratio of zinc to phosphate, calculated as $P_2O_5$, is in the range from (0 to 1): 8.

2. The process of claim 1 wherein the solution contains additional layer forming ions.

3. The process of claim 1 wherein the surface is contacted with a phosphating solution which contains nitrate as an accelerator.

4. The process of claim 1 wherein the surface is contacted with a phosphating solution which has an S value in the range from 0.2 to 0.3.

5. The process of claim 1 wherein the galvanized surface is a galvanized steel strip.

6. The process of claim 1 wherein the surface is contacted with a phosphating solution which contains nickel ions in an amount of up to 0.5 g/l.

7. The process of claim 1 wherein the surface is contacted with a phosphating solution which additionally contains simple or complex fluoride in an amount of up to 3 g/l calculated as F in each case.

8. The process of claim 1 wherein the surface is contacted with a phosphating solution which is replenished with a zinc-free concentrate.

9. The process of claim 1 wherein the surface is contacted with a phosphating solution which is replenished with a concentrate in which the weight ratio of $NO_3$:-$P_2O_5$ is in the range from (0.15 to 0.7):1.

10. The process of claim 9 wherein the concentrate has a weight ratio of $NO_3$:$P_2O_5$ in the range from (0.3 to 0.5):1.

11. The process of claim 10 wherein the galvanized steel strip is electrolytically galvanized.

12. The process of claim 1 wherein the surface is contacted with a phosphating solution which contains up to 1.5 g/l zinc at a weight ratio of magnesium: zinc of (0.5 to 3):1.

13. The process of claim 12 wherein the surface is contacted with a phosphating solution which contains 0.5 to 1 g/l zinc.

14. A method of preparing a galvanized surface for a subsequent painting or a covering with a preformed organic film comprising: contacting the surface for a period (O<t) up to 10 seconds with an aqueous solution which comprises 0.5 to 5.0 g/l zinc, greater than 0 and up to 1.5 g/l nickel, 3 to 20 g/l phosphate calculated as $P_2O_5$, 0.3 to 3 g/l magnesium, and an accelerator, the solution having a weight ratio of magnesium : zinc=(0.5 to 10): 1 and an S value in the range from 0.1 to 0.4; and replenishing the solution with a concentrate in which the weight ratio of zinc to phosphate, calculated as $P_2O_5$, is in the range from (0 to 1): 8.

15. The process of claim 11 wherein the surface is contacted with a phosphating solution which contains nickel ions in an amount of up to 0.5 g/l.

16. The process of claim 11 wherein the surface is contacted with a phosphating solution which additionally contains simple or complex fluoride in an amount of up to 3 g/l calculated as F in each case.

17. The process of claim 11 wherein the surface is contacted with a phosphating solution which is replenished with a zinc-free concentrate.

18. The process of claim 11 wherein the solution contains additional layer forming ions.

19. The process of claim 11 wherein the surface is contacted with a phosphating solution which contains nitrate as an accelerator.

20. The process of claim 11 wherein the surface is contacted with a phosphating solution which has an S value in the range from 0.2 to 0.3.

21. The process of claim 11 wherein the galvanized surface is a galvanized steel strip.

22. The process of claim 17 wherein the surface is contacted with a phosphating solution which contains single or complex fluoride in an amount of 0.1 to 1.5 g/l.

23. The process of claim 11 wherein the surface is contacted with a phosphating solution which is replenished with a concentrate in which the weight ratio of $NO_3$: $P_2O_5$ is in the range from (0.15 to 0.7): 1.

24. The process of claim 23 wherein the concentrate has a weight ratio of $NO_3$: $P_2O_5$ in the range from (0.3 to 0.5): 1.

25. The process of claim 20 wherein the galvanized steel strip is electrolytically galvanized.

26. The process of claim 11 wherein the surface is contacted with a phosphating solution which contains up to 1.5 g/l zinc at a weight ratio of magnesium:zinc of (0.5 to 3): 1.

27. The process of claim 26 wherein the surface is contacted with a phosphating solution which contains 0.5 to 1 g/l zinc.

28. The process of claim 17 wherein the surface is contacted with a phosphating solution which contains single or complex fluoride in an amount of 0.1 to 1.5 g/l.

* * * * *